US006966081B1

(12) United States Patent
Sharps et al.

(10) Patent No.: US 6,966,081 B1
(45) Date of Patent: Nov. 22, 2005

(54) TRANSPORT AND POSITIONING SYSTEM FOR USE IN HOSPITAL OPERATING ROOMS

(76) Inventors: Lewis Sharps, 911 Lafayette Rd., Bryn Mawr, PA (US) 19010; Rakesh Batish, 189 Abbey Dr., Royersford, PA (US) 19468

( * ) Notice: Subject to any disclaimer, the term of this patent is extended or adjusted under 35 U.S.C. 154(b) by 52 days.

(21) Appl. No.: 10/866,852

(22) Filed: Jun. 14, 2004

(51) Int. Cl.[7] ..... A61G 7/10; A61G 13/12; A61G 13/08

(52) U.S. Cl. ..... 5/81.1 R; 5/621; 5/713; 5/715

(58) Field of Search ..... 5/81.1 R, 715, 5/710, 713, 86.1, 615, 621

(56) References Cited

U.S. PATENT DOCUMENTS

| | | | | | |
|---|---|---|---|---|---|
| 3,485,240 | A | * | 12/1969 | Fountain | 601/148 |
| 3,775,781 | A | * | 12/1973 | Bruno et al. | 5/607 |
| 4,807,313 | A | | 2/1989 | Ryder et al. | |
| 4,977,629 | A | * | 12/1990 | Jones | 5/632 |
| 5,005,232 | A | | 4/1991 | Wright et al. | |
| 5,073,999 | A | | 12/1991 | Thomas et al. | |
| 5,092,007 | A | | 3/1992 | Hasty | |
| 5,412,823 | A | | 5/1995 | Sitta | |
| 5,506,012 | A | | 4/1996 | Wright et al. | |
| 5,774,917 | A | * | 7/1998 | Liu | 5/715 |
| 6,070,281 | A | | 6/2000 | Reich | |
| 6,085,372 | A | * | 7/2000 | James et al. | 5/713 |
| 6,119,292 | A | * | 9/2000 | Haas | 5/715 |
| 6,154,900 | A | | 12/2000 | Shaw | |
| 6,216,294 | B1 | | 4/2001 | Wess | |
| 6,260,220 | B1 | | 7/2001 | Lamb et al. | |
| 6,298,511 | B1 | * | 10/2001 | Collymore | 5/715 |
| 6,327,724 | B1 | | 12/2001 | Sharrock et al. | |
| 6,510,574 | B2 | | 1/2003 | Sharrock et al. | |
| 2002/0040501 | A1 | | 4/2002 | Sharrock et al. | |

* cited by examiner

*Primary Examiner*—Alexander Grosz
(74) *Attorney, Agent, or Firm*—Caesar, Rivise, Bernstein, Cohen & Pokotilow, Ltd.

(57) ABSTRACT

A system for transporting and positioning a patient onto an operating room table from a movable transportation device, e.g., a stretcher, to be located immediately laterally of the operating room table and transporting back onto the movable transportation device after the surgery. The system basically comprises a first and second inflatable assemblies to effect the pivoting of the patient about a longitudinal axis extending between the table and stretcher from a supine position on the stretcher to a horizontal prone position on the table. A third inflatable assembly causes the patient's spine to be in an arcuate orientation suitable for spinal surgery.

36 Claims, 14 Drawing Sheets

FIG.4C
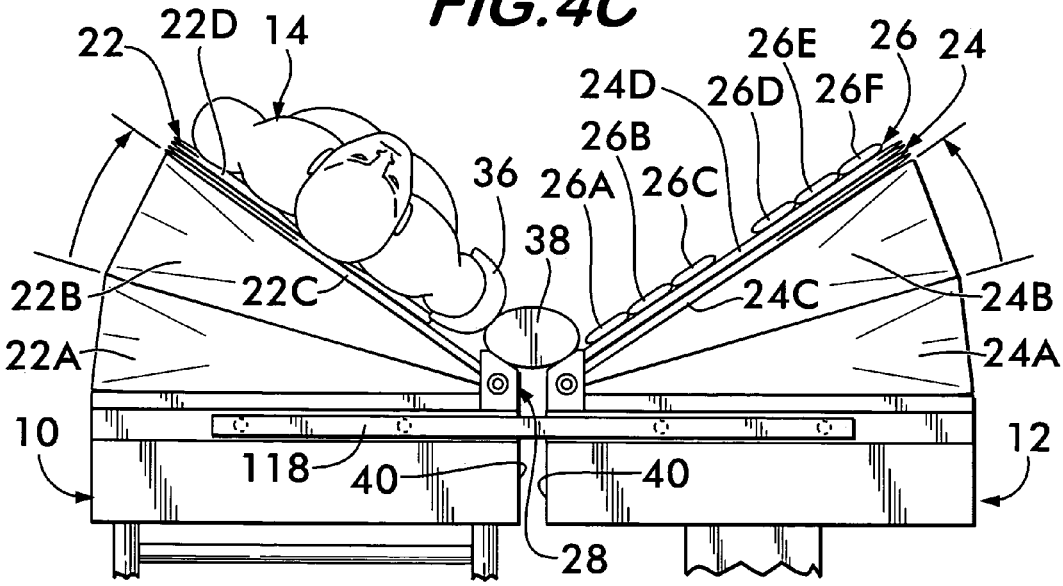
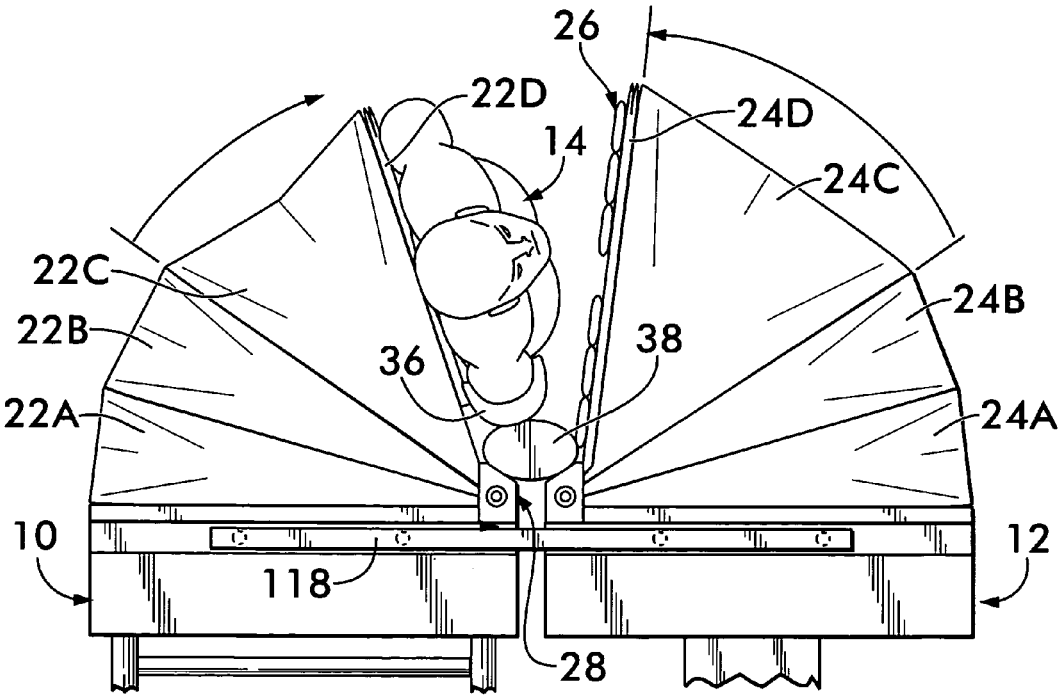
FIG.4D

FIG.4G
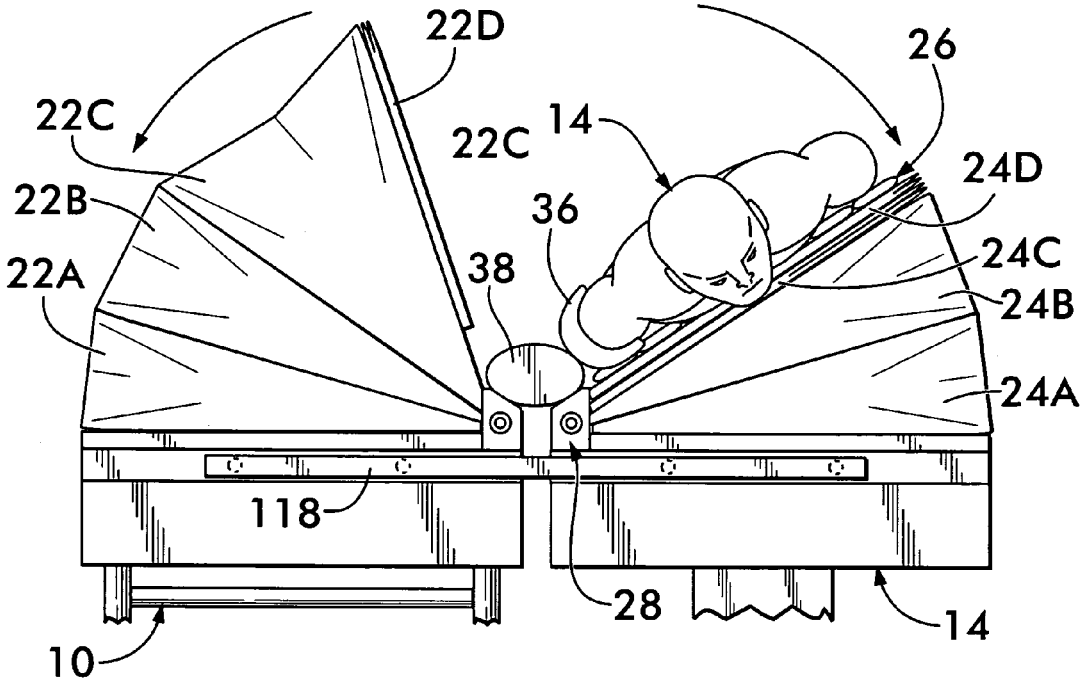
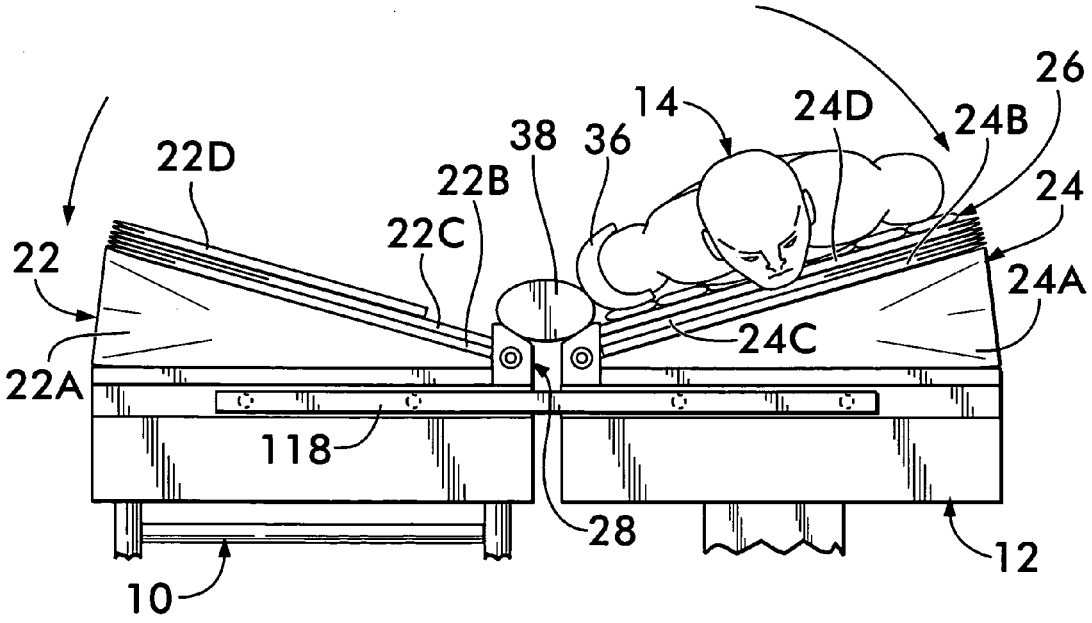
FIG.4H

FIG.4I
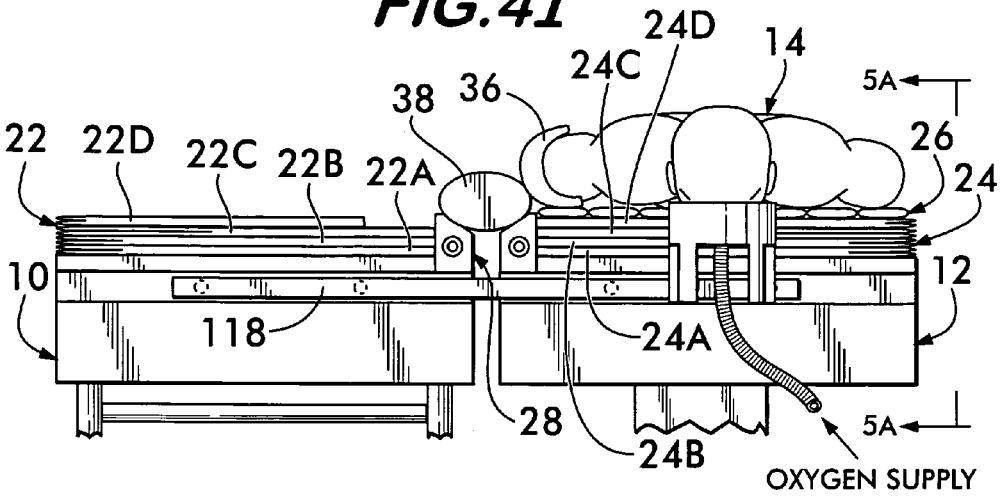
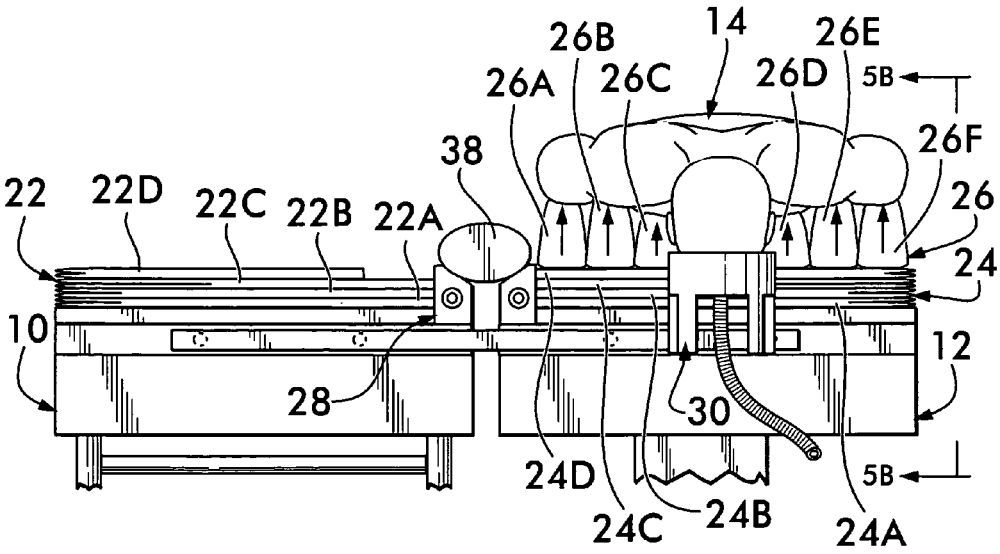
FIG.4J

FIG.5A
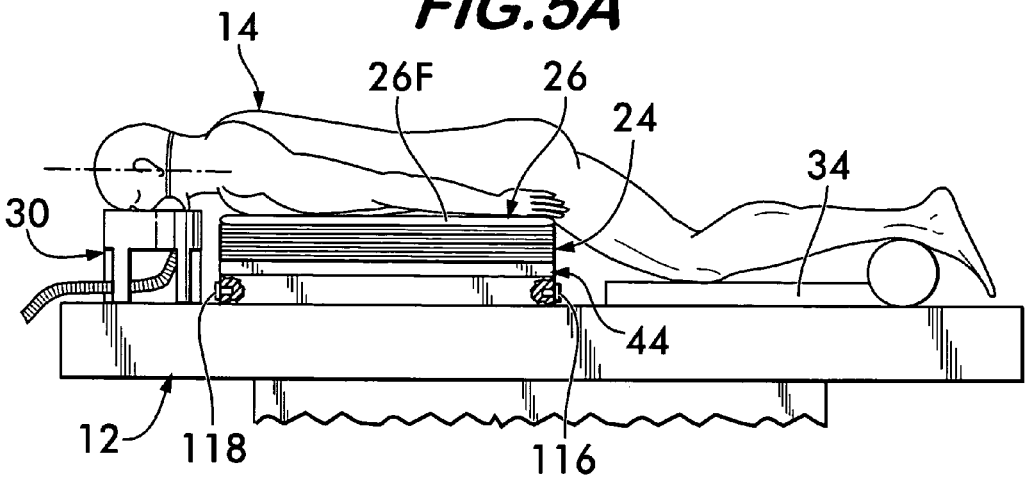
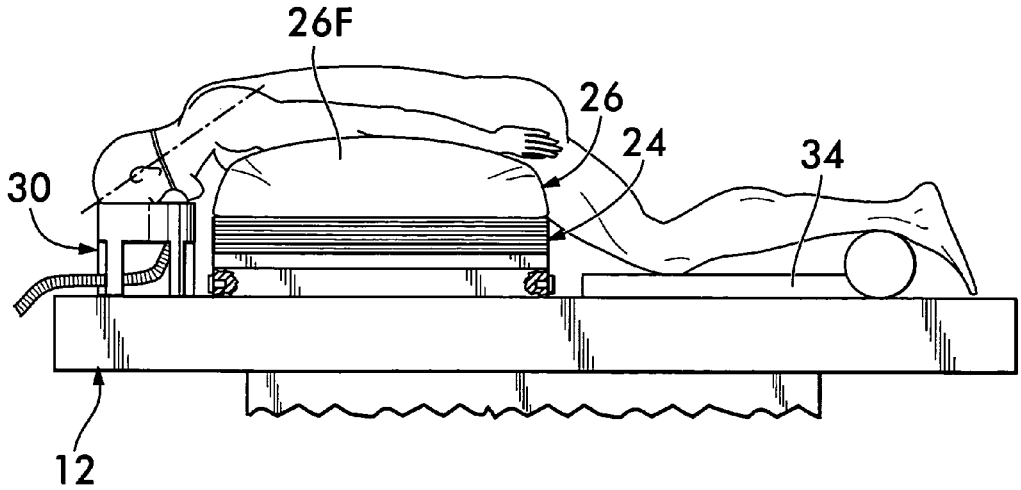
FIG.5B

TRANSPORT AND POSITIONING SYSTEM FOR USE IN HOSPITAL OPERATING ROOMS

BACKGROUND OF THE INVENTION

1. Field of Invention

This invention relates generally to patient transport and positioning systems and more particularly to systems for transporting a supine patient from a stretcher, gurney, litter or similar device and into a prone position on an operating room table and positioning for spinal or general surgery and after surgery a prone positioned patient is transported back to stretcher, gurney, litter or similar device in original supine patient position.

2. Description of Related Art

Various devices are commercially available for positioning patients on operating room tables and several patents disclose devices of that nature. Some of these devices basically comprise inflatable balloon, pads or mattresses. See for example, U.S. Pat. No. 4,807,313 (Ryder et al.), U.S. Pat. No. 5,092,007 (Hasty), U.S. Pat. No. 5,506,012 (Wright), U.S. Pat. No. 6,154,900 (Shaw), U.S. Pat. No. 6,216,294 (Wess), U.S. Pat. No. 6,327,724 (Sharrock et al.), U.S. Pat. No. 6,510,574 (Sharrock et al.) and published application U.S. 2002/0040501A1 (Sharrock et al.). Other devices basically comprise mechanical tables for rotating a patient. See for example, U.S. Pat. No. 5,073,999 (Thomas et al.), U.S. Pat. No. 5,412,823 (Sitta), U.S. Pat. No. 6,070,281 (Reich), U.S. Pat. No. 5,005,232 (Wright et al.) and U.S. Pat. No. 6,260,220 (Lamb et al.).

All references cited herein are incorporated herein by reference in their entireties.

While the above devices may be generally suitable for their intended purposes, they leave something to be desired from one or more of the following factors, complexity, ease of use, effectiveness, adaptability to conventional operating room tables and transportation devices (e.g., gurneys, etc.).

BRIEF SUMMARY OF THE INVENTION

A system for transporting and positioning a patient onto an operating room table from a movable transportation device, e.g., a stretcher, gurney, litter, etc., wherein the patient is disposed in a supine position on that device. The transportation device is arranged to be located immediately laterally of the operating room table.

The system basically comprises a first inflatable member and a second inflatable member. The first inflatable member has a generally horizontally oriented patient supporting surface, a lateral inside edge and is arranged to be located on the movable transport device with the patient in a supine position on the patient supporting surface. The second inflatable member has a generally horizontally oriented patient receiving surface, a lateral inside edge and is arranged to be located on the operating room table and releasably coupled to the first inflatable member when the transportation device is located immediately laterally of the operating room table. The first inflatable member is arranged to be inflated to rotate the supine patient about an axis extending generally parallel to the lateral inside edge of the first inflatable member through an arc slightly in excess of 90 degrees. The second inflatable member is arranged to rotate the patient receiving surface through an arc slightly less than 90 degrees, whereupon the patient is transferred in a prone orientation to the patient receiving surface of the second inflatable member. The patient receiving surface of the second inflatable member is arranged to thereafter be rotated back to its initial horizontal orientation, whereupon the patient is prone on the operating room table.

In accordance with one exemplary aspect of this invention, once the patient has been placed in the prone position on the operating room table the first inflatable member can be uncoupled from the second inflatable member and it and the transportation device can be moved away from the operating room table to enable the operation on the patient to proceed. If the transportation device has been moved away, after the operation on the patient has been completed the transportation device with the first inflatable member on it is moved back into position immediately laterally of the operating room table and the first and second inflatable members are again coupled together. The second inflatable member is arranged to be inflated to rotate the horizontally prone patient on the operating room table about an axis extending generally parallel to the lateral inside edge of the second inflatable member through an arc slightly in excess of 90 degrees. The first inflatable member is arranged to rotate the patient supporting surface through an arc slightly less than 90 degrees, whereupon the patient is transferred to the patient supporting surface of the first inflatable member in a supine orientation. The first inflatable member is arranged to thereafter be rotated back to its initial horizontal orientation, whereupon the patient is supine on the movable transportation device. The first and second inflatable members can then be uncoupled from each other and the transportation device with the supine patient on it can then be moved out of the operating room.

In accordance with another preferred aspect of this invention the system additionally includes a third inflatable member. The third inflatable member has a lateral inside edge and is disposed on the second inflatable member with the inside edge of the second and third inflatable members being adjacent each other. The third inflatable member being arranged when inflated to cause the spine of the prone patient to assume the convex arched shape that is desirable for spinal surgery. The third inflatable member may be made up of plural longitudinally extending chambers, with the outermost of the longitudinally extending chambers being arranged when inflated to extend to a greater height than the innermost of the longitudinally extending chambers. This ensures that the patient is supported from the chest and pelvis, but there is an area of decompression along the centerline of the patient. The amount of inflation of the longitudinally extending chambers can be adjustable to accommodate various size patients.

BRIEF DESCRIPTION OF SEVERAL VIEWS OF THE DRAWINGS

The invention will be described in conjunction with the following drawings in which like reference numerals designate like elements and wherein:

FIG. 4C is an end view, like that of FIGS. 4A–4B, but showing the system at a later stage in the inflation of its components to effect the transference of the patient;

FIG. 4D is an end view, like that of FIGS. 4A–4C, but showing the system at a still later stage in the inflation of its components to effect the transference of the patient;

FIG. 4G is an end view, like that of FIGS. 4A–4F, but showing the system at a still later stage in the inflation of its components to effect the transference of the patient;

FIG. 4H is an end view, like that of FIGS. 4A–4G, but showing the system at a still later stage in the inflation of its components to effect the transference of the patient;

FIG. 4I is an end view, like that of FIGS. 4A–4H, but showing the system at a still later stage in the inflation of its components to effect the transference of the patient;

FIG. 4J is an end view, like that of FIGS. 4A–4G, but showing the system wherein the patient has been transferred to the operating room table and some components of the system inflated to cause the spine of the prone patient to assume a convex shape suitable for spinal surgery;

FIG. 5A is a side elevation view taken along line 5A—5A of FIG. 4I;

FIG. 5B is a side elevation view taken along line 5B—5B of FIG. 4J;

DETAILED DESCRIPTION OF THE INVENTION

Figure 1:
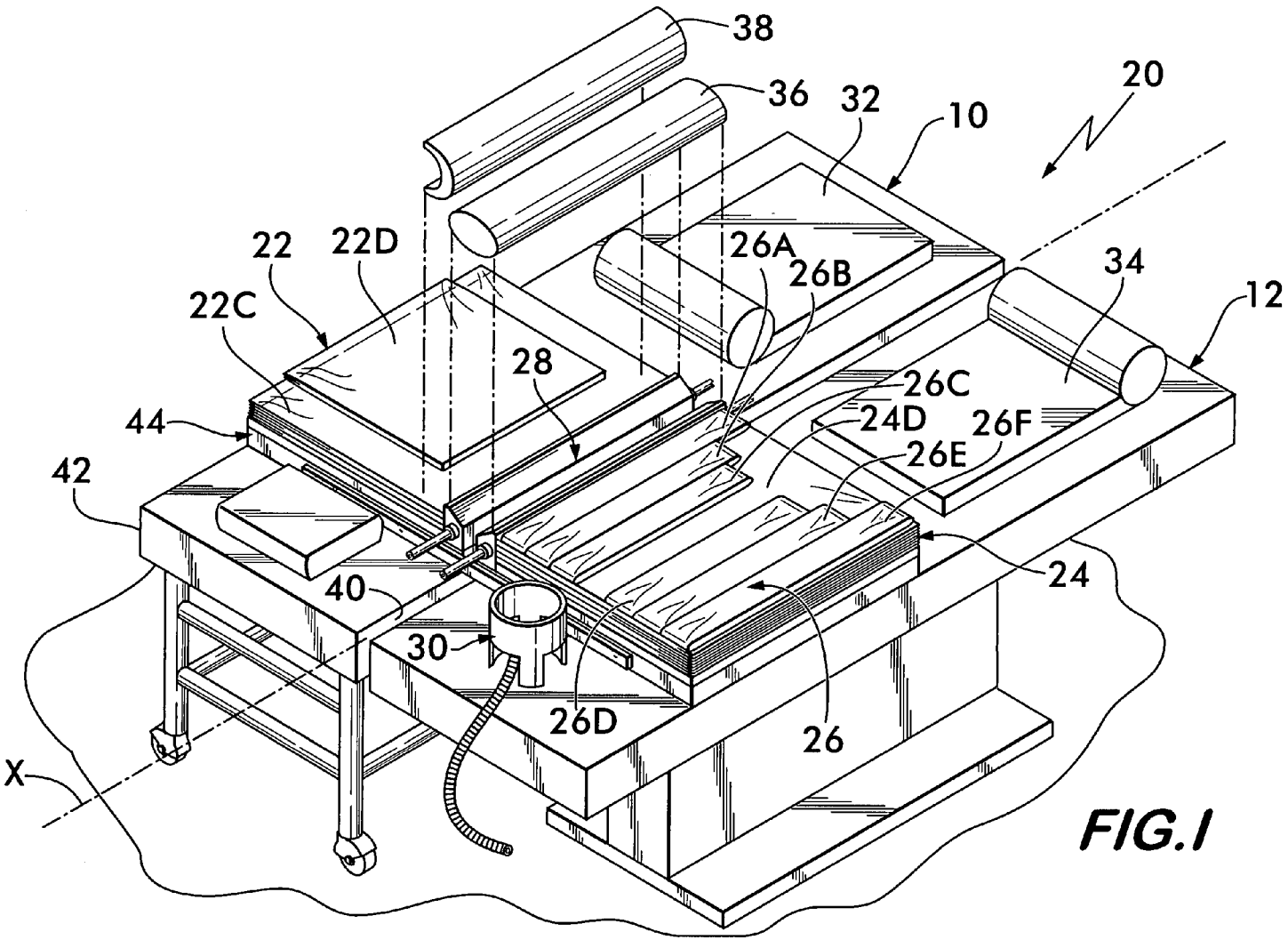
FIG. 1 is an isometric view, partially exploded, of one exemplary embodiment of a patient transport and positioning system constructed in accordance with this invention shown in use on a conventional gurney or stretcher and a conventional operating room table.
Figure 2:
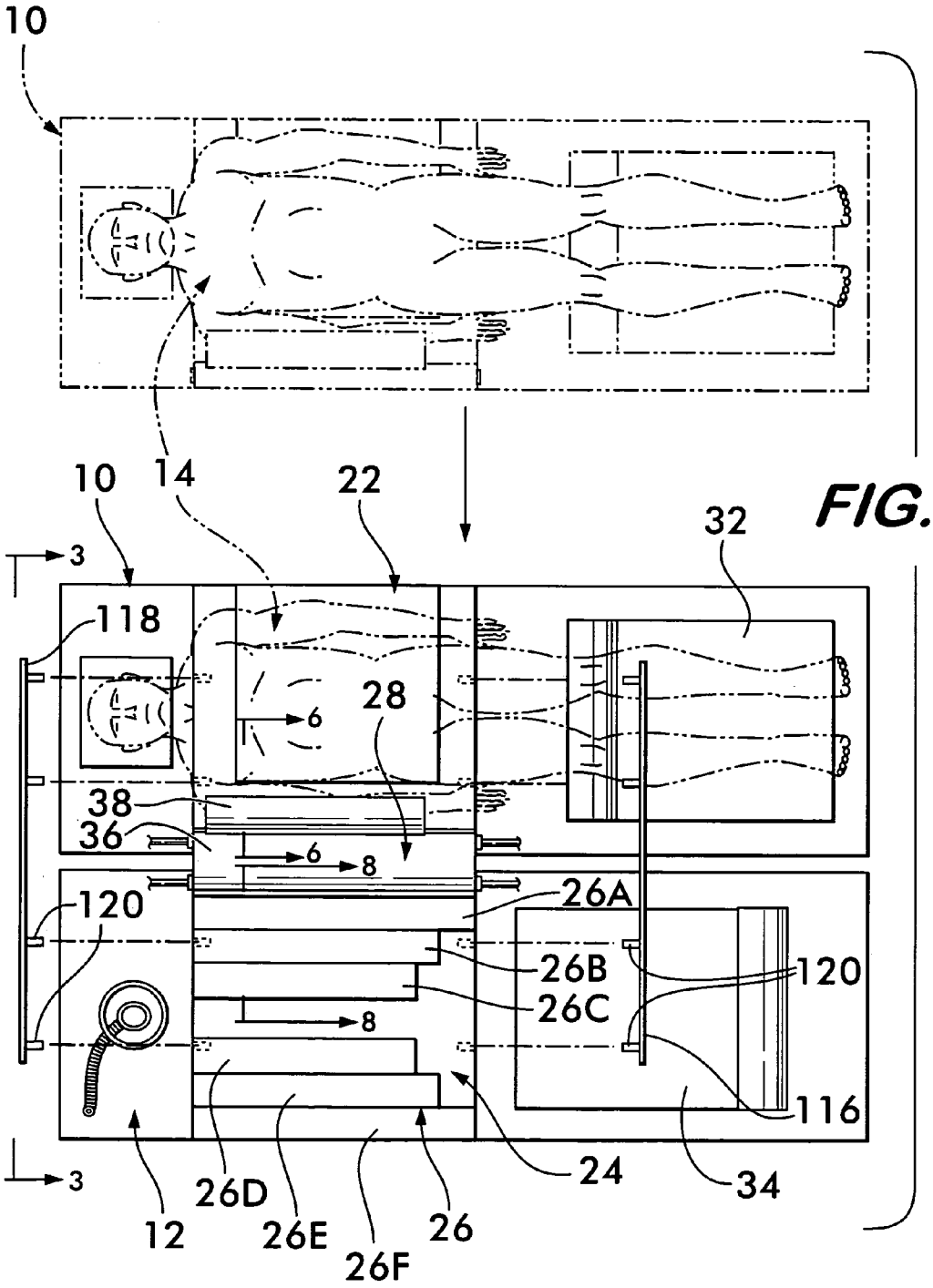
FIG. 2 is a top plan view of the system shown in FIG. 1, wherein a patient on a gurney or stretch is into position in the operating room for disposition in a prone position on the operating room table.
Figure 3:
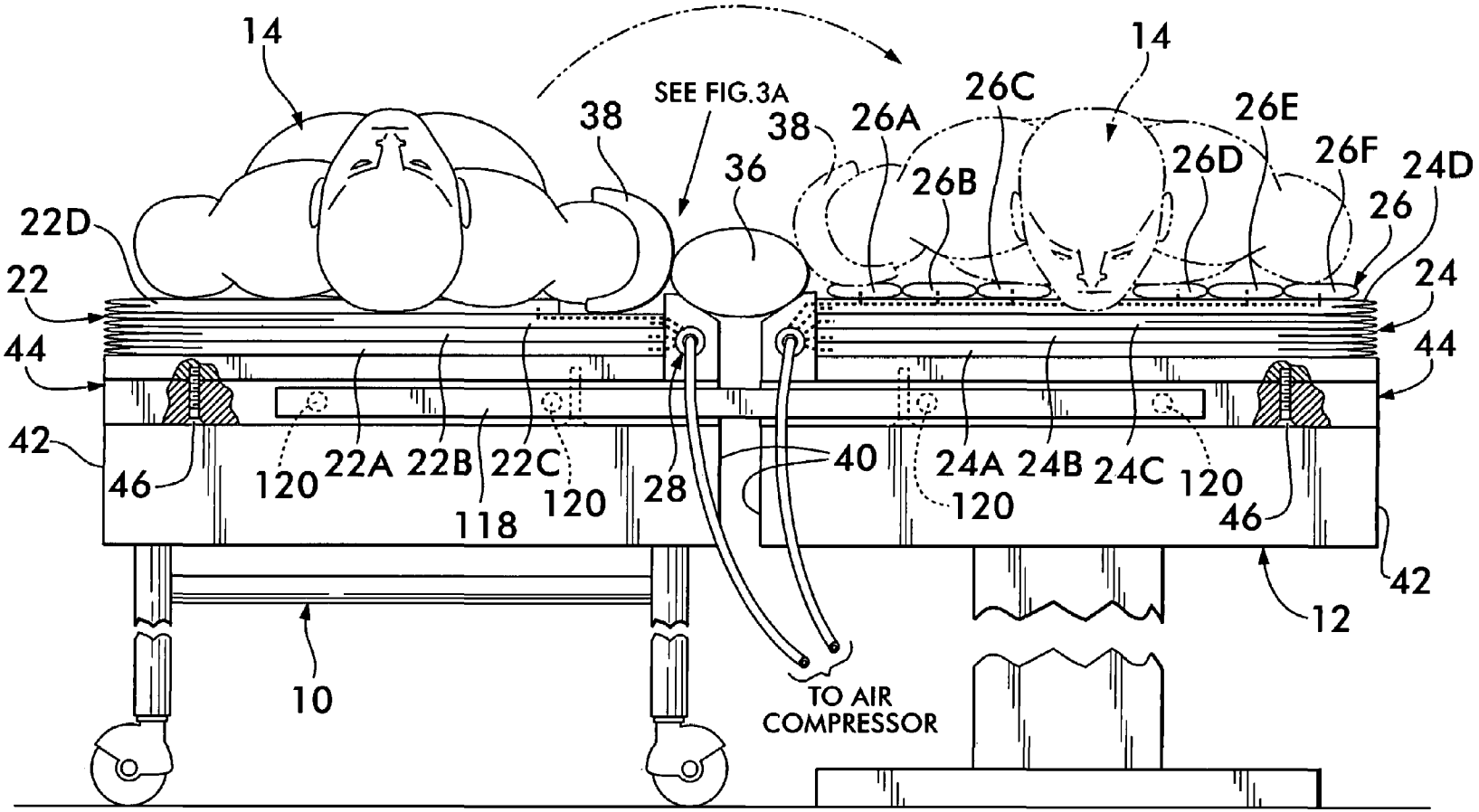
FIG. 3 is an enlarged end view taken along line 3—3 of FIG. 2.

Referring now to the various figures of the drawing wherein like reference characters refer to like parts, there is shown at 20 in FIG. 1 one exemplary embodiment of a patient transport and positioning system for use in a hospital operating room constructed in accordance with this invention. The system can be used for conducting any type of medical procedure requiring a patient to be in a particular orientation, such as when the patient is under a general anesthetic or intravenous sedation during a surgical procedure, e.g., back surgery. The system 20 basically comprises two inflatable assemblies 22 and 24, one of which, 22, is arranged to be disposed on a conventional patient transport device 10, such as a stretcher, gurney, litter or the like. The other assembly 24 is arranged to be disposed on a conventional operating room table 12. Each of these assemblies will be described in detail later. Suffice it for now to state that the first assembly 22 is arranged to support a patient 14 in the supine position on it (see FIG. 2) so that the patient can be brought into the operating room, with the stretcher, gurney or whatever transportation device utilized being located immediately laterally beside the operating room table, like shown in FIG. 1. The two assemblies 22 and 24 are arranged to be releasably coupled together by means (to be described later) when the stretcher is located immediately adjacent the operating room table as shown in FIGS. 1–3.

The top surface of the assembly 22, which will be described later, serves to receive the patient thereon in a horizontal supine position. That surface will be referred to as the patient supporting surface. The assembly 22 is arranged, when operated, to rotate the patient on the patient supporting surface through an arc slightly in excess of 90 degrees about a longitudinal axis X extending between the stretcher 10 and the table 12 to a "patient transfer" position at which the second assembly 24 receives the patient. To that end, the assembly 24 also includes a top surface (to be described later) which is referred to hereinafter as the "patient receiving surface." The assembly 24 is arranged to operate in conjunction and coordination with the assembly 22 so that when the patient is rotated to the patient transfer position, that is slightly beyond the vertical orientation, the assembly 24 will receive the patient on its patient receiving surface so that the patient is prone on that surface. The assembly 24 is further operated to rotate the patient downward until the patient is disposed horizontally. The horizontally prone patient on the operating room table is now in position whereupon surgery can be conducted on the patient's back (or any other portion of the rear of the patient).

In accordance with the preferred aspect of this invention the system 20 also includes an additional assembly 26 in the form of plural expandable components (to be described in detail later) for causing the spine of the horizontally prone patient to curve in a downward convex direction, as is commonly required for spinal surgery. Once the patient is in the desired position on the operating room table 12, the assemblies 22 and 24 are decoupled from each other to enable the stretcher 10 to be moved away from the operating room table 12, thereby providing the surgeon with access to the patient from all directions.

After the surgery has been completed and when it is desired to transfer the patient out of the operating room, the third assembly (if utilized) is operated to return the patient to the normally generally planar horizontally prone orientation, i.e., to enable the patient's spine to return from the downwardly curved position created by the assembly 26 for the surgery to its normal degree of curvature. The stretcher 10 is then moved back to the position immediately adjacent laterally the operating room table as shown in FIGS. 1–3 and the two assemblies 22 and 24 are recoupled together. The assembly 24 on the operating room table and the assembly 22 on the stretcher are then operated in a similar, albeit reverse, manner as described above to cause the patient to be rotated back from the horizontally prone position on the operating room table 12 to the horizontally supine position on the stretcher 10. Once the patient is back in the horizontally supine position on the stretcher, the two assemblies 22 and 24 of the system can be again uncoupled and the stretcher rolled away to remove the patient from the operating room.

It should be pointed out at this juncture that the assemblies 22 and 24 of the system 20 may form an integral portion of the stretcher and the operating room table, respectively, or may be arranged to be removably mounted thereon.

In accordance with one exemplary embodiment of this invention, the assembly 22 is in the form of plural inflatable members. Similarly, the assembly 24 is in the form of plural inflatable members. So, too, if an assembly 26 is utilized, it is also in the form of plural inflatable members. All of the inflatable members are formed of a relatively soft flexible yet strong and airtight material. The system 20 additionally comprises a manifold assembly 28, including a pair of housings and associated common manifold pipes (to be described later). Each of these manifold pipes is arranged to be coupled to a source of fluid, e.g., compressed air (not shown). Additionally, a face cradle 30 is preferably provided and is located on the operating room table 12 to receive the face of the patient when the patient is in the prone position. An optional pair of legs/footrests 32 and 34 may also be provided. In the interest of effecting the smooth and safe transfer of the patient from the stretcher to the operating room table and then back to the stretcher the system 20 additionally comprises a fulcrum assembly 36 and a shoulder support 38.

The face cradle 30 preferably includes an oxygen supply tube and/or other tubes for releasable coupling to the patient's face. The optional footrest 32 and 34 can be used to support the patient's knees as the patient is supine on the stretcher and to support the patient's feet as the patient is prone on the operating room table. The shoulder support 38 is coupled to the fulcrum 36 to expedite the rotation of the patient from the horizontal supine position on the stretcher to the horizontal prone position on the operating room table and vice versa, as will be described later.

Figure 6:
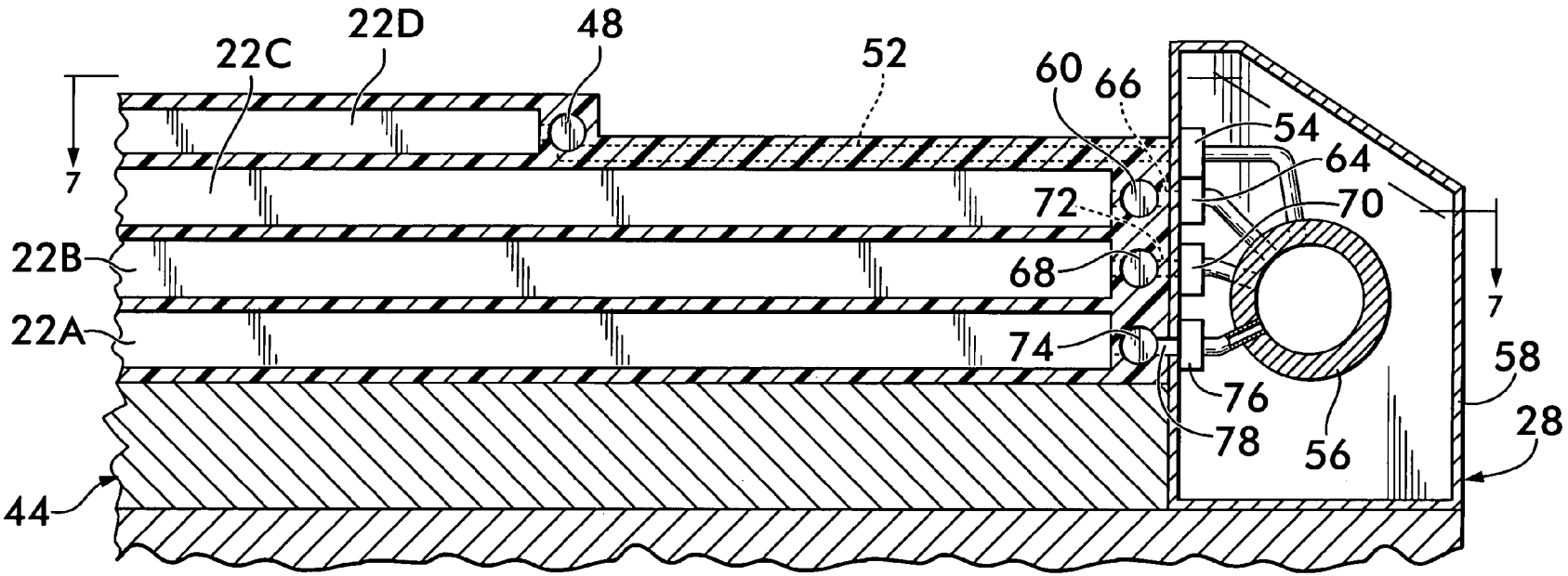
FIG. 6 is an enlarged sectional view taken along line 6—6 of FIG. 2.
Figure 7:
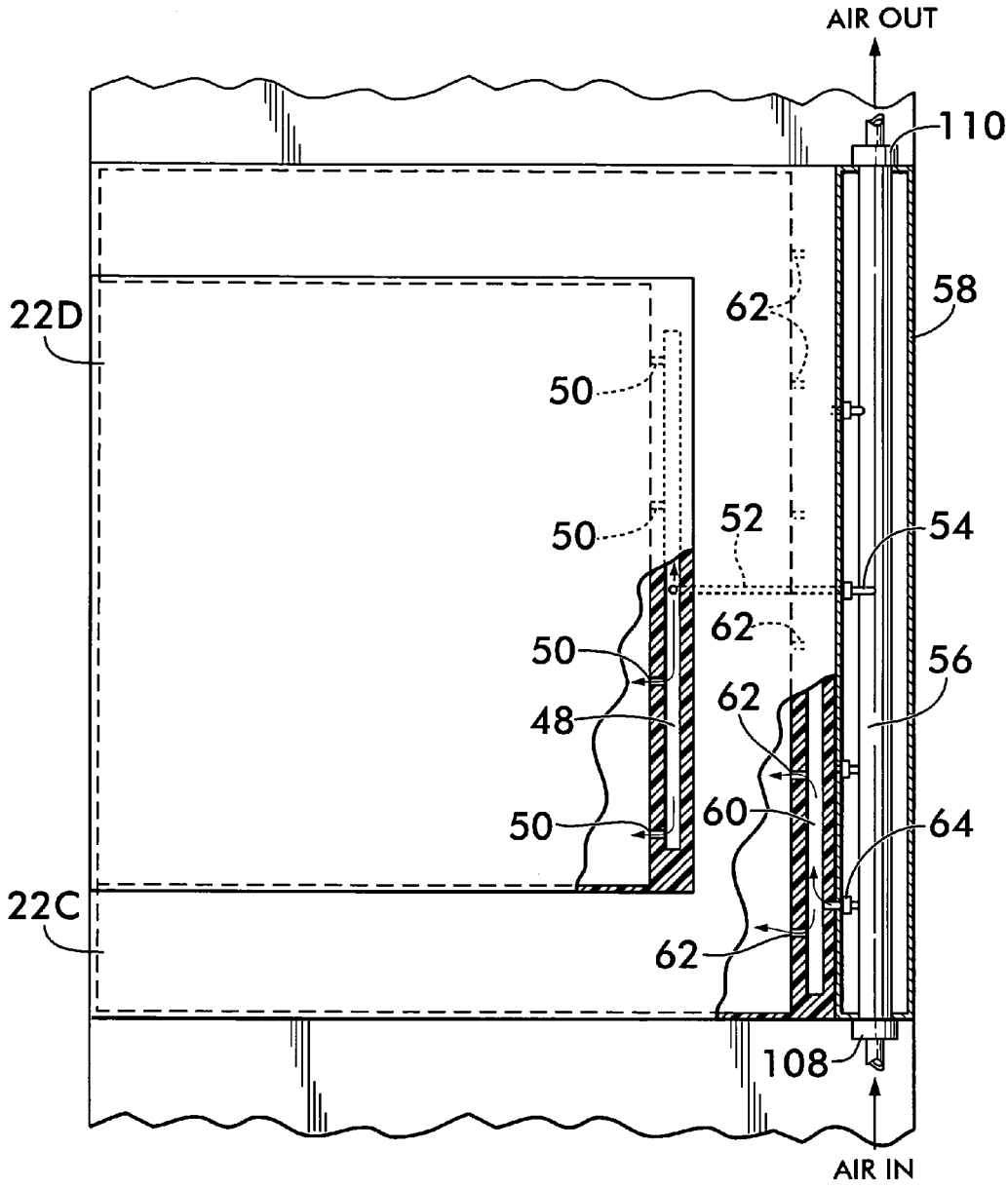
FIG. 7 is a partial sectional view taken along line 7—7 of FIG. 6.

Referring now to FIGS. 3, 6 and 7, it can be seen that the inflatable components of the assembly 22 comprise a plurality, e.g., four, inflatable chambers or bags 22A, 22B, 22C and 22D. Each chamber, when fully inflated is of a wedge shape and flares outward from a short height edge located closely adjacent the inside lateral edge 40 of the stretcher 10 to a long height edge located adjacent the outside lateral edge 42 of the stretcher. The chambers 22A, 22B, and 22C are all coextensive in size. The topmost chamber 22D is slightly smaller in size and its inner marginal edge is located spaced inward from the inner marginal edges of the underlying chambers 22C, 22B and 22A. The length of the uppermost chamber 22D is also shorter than the underlying chambers 22C, 22B and 22A. The chambers 22C, 22B and 22A are all of the same size and cross-sectional area.

Figure 10:
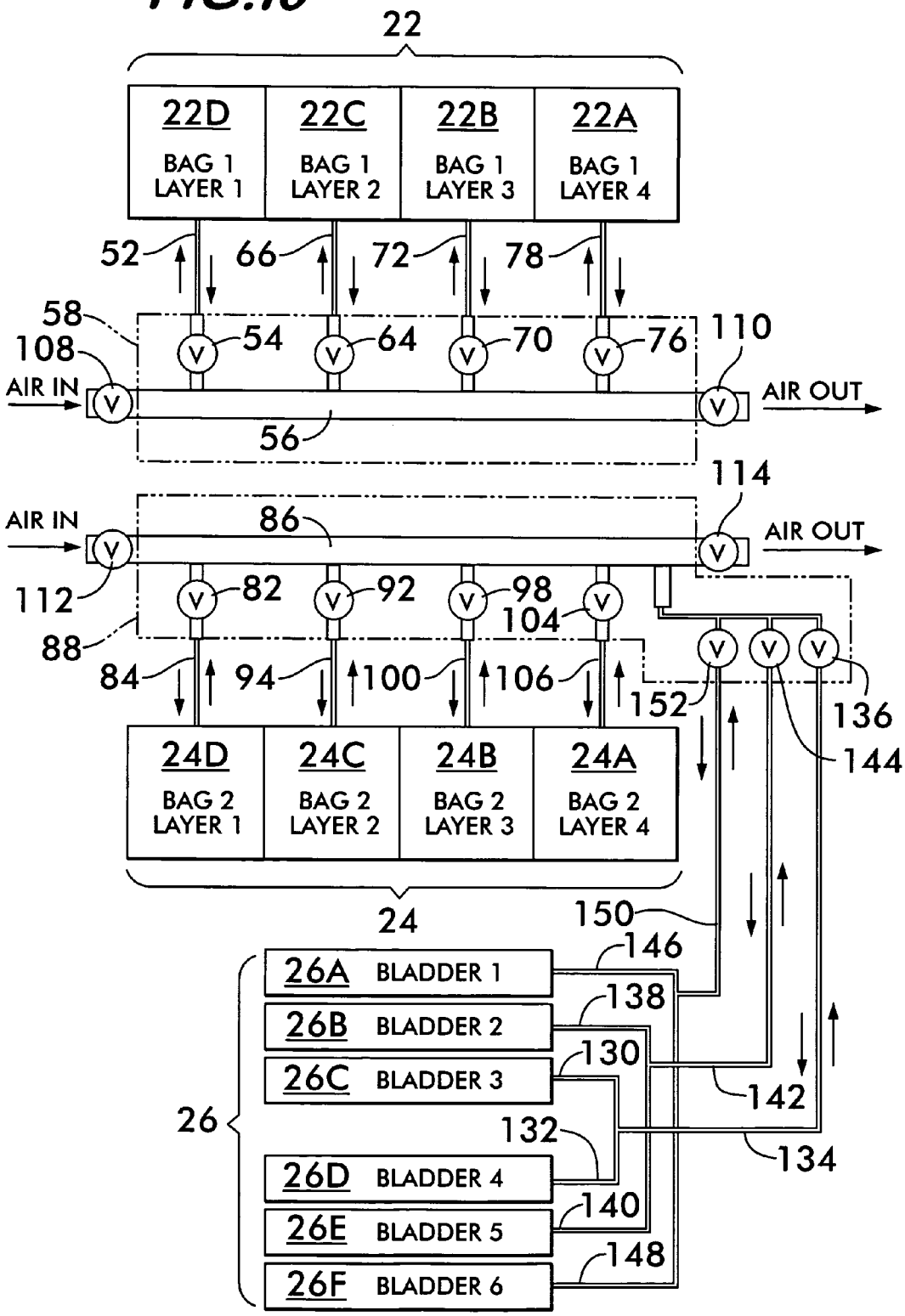
FIG. 10 is a diagram of the various pneumatic components making up the system of FIG. 1.

In FIG. 10 there is shown a schematic diagram of the assemblies 22, 24 and 26. The inflatable chambers 22D, 22C, 22B and 22A of the assembly 22 are identified in that diagram as being "bag 1 layer 1", "bag 1 layer 2", "bag 1 layer 3", and "bag 1 layer 4", respectively. This represents that the chamber 22A is the fourth or lowermost chamber, that chamber 22B is the third or next lowermost chamber, that chamber 22C is the second or next uppermost chamber and that chamber 22D is the first or uppermost chamber.

As best seen in FIG. 3 the lowermost or fourth chamber 22A is mounted on a base plate subassembly 44. That subassembly includes a top base plate member and a bottom base plate member. The bottom base plate member is secured (fixedly or releasably) to the top of the stretcher 10. The top base plate of the subassembly 44 is secured to the bottom base plate by plural screws 46.

Figure 4A:
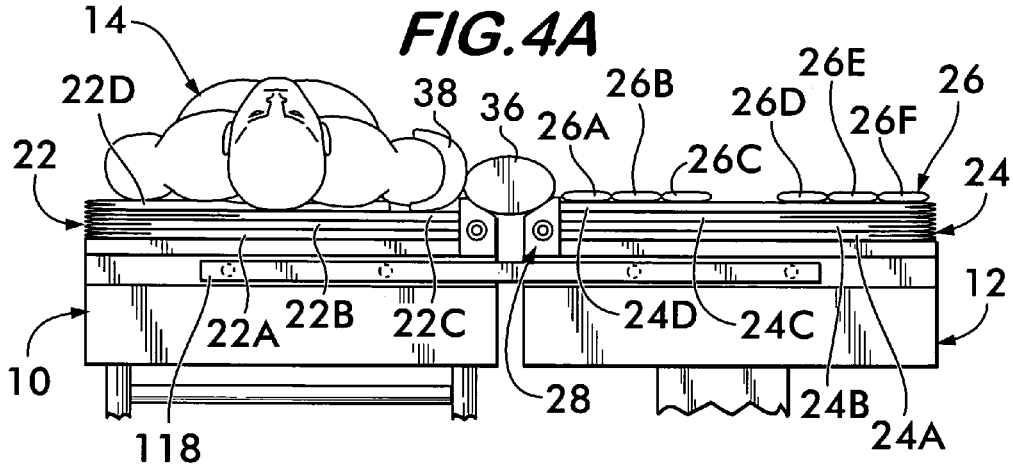
FIG. 4A is an end view showing the system of FIG. 1 showing the operation of the system of FIG. 1, namely, with a patient in a supine orientation on the gurney or stretcher ready to be transferred into a prone orientation on the operating room table.
Figure 4B:
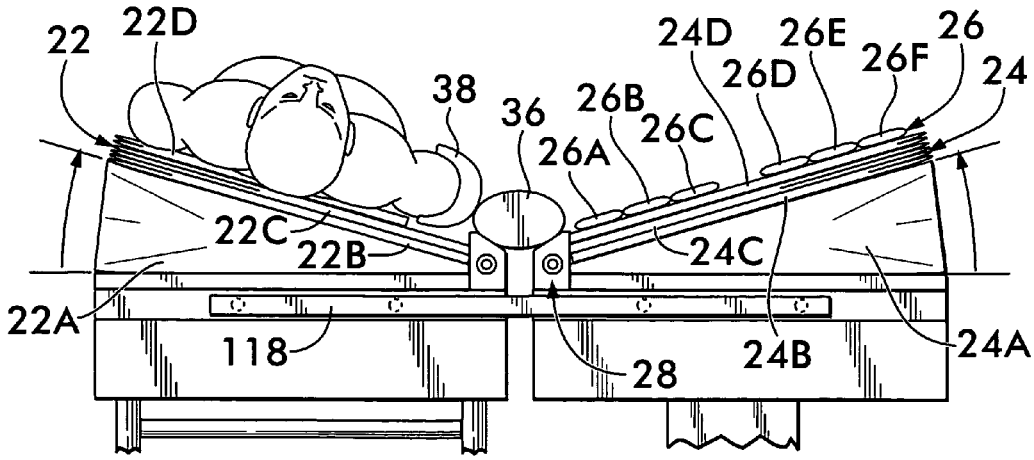
FIG. 4B is an end view, like that of FIG. 4A, but showing the system at an early stage in the inflation of its components to effect the transference of the patient.
Figure 4E:
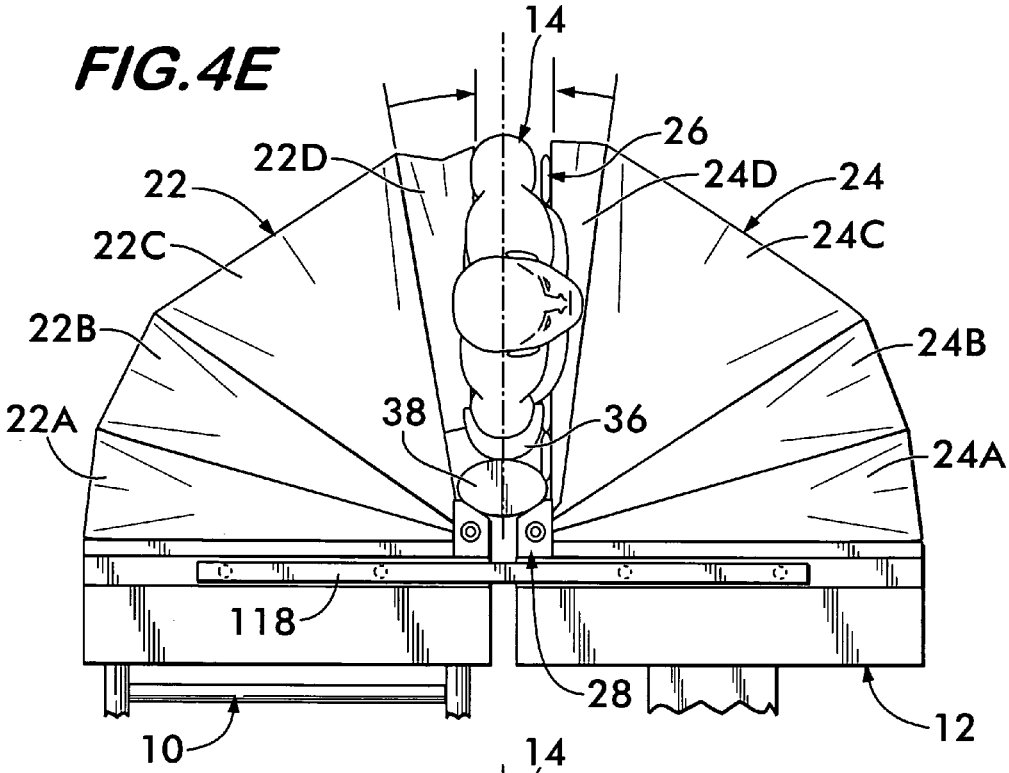
FIG. 4E is an end view, like that of FIGS. 4A–4D, but showing the system at a still later stage in the inflation of its components to effect the transference of the patient.
Figure 4F:
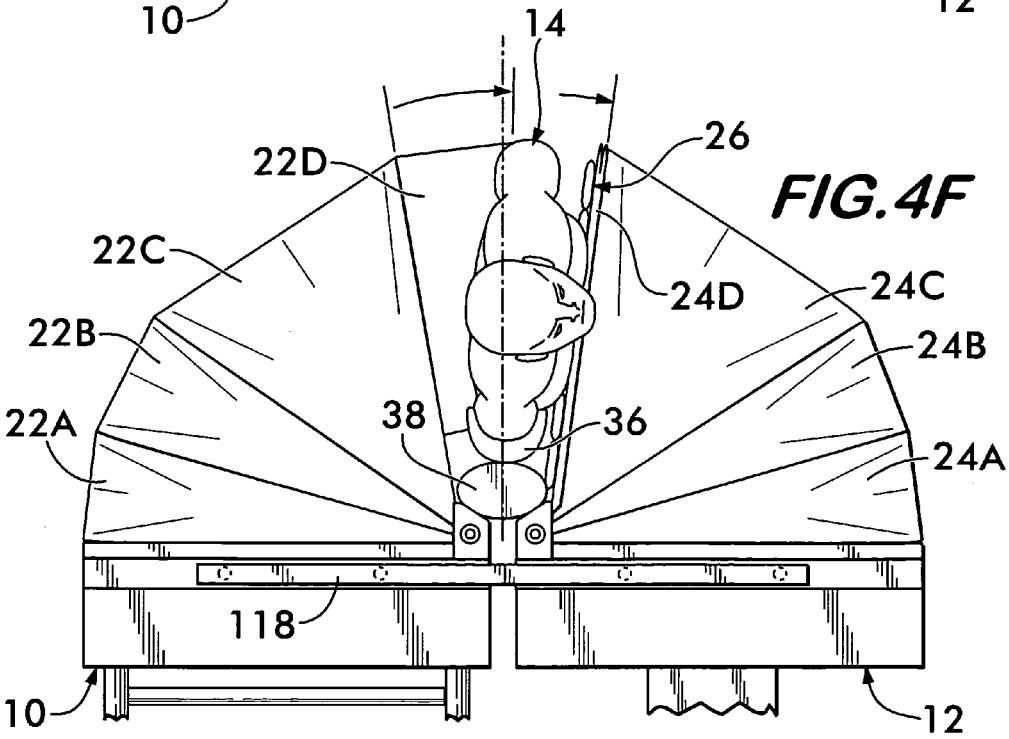
FIG. 4F is an end view, like that of FIGS. 4A–4E, but showing the system at a still later stage in the inflation of its components to effect the transference of the patient.

Each of the chambers 22A–22D is arranged to be inflated to cause it to extend from its compact flattened state as shown in FIG. 6 to its respective fully expanded wedge shaped states shown in FIG. 4F. The inflation of the chambers 22A–22D is accomplished sequentially starting with chamber 22A, then chamber 22B, then chamber 22C and finally ending with chamber 22D (as will be described later) to effect the rotation of the patient as mentioned previously. The means for inflating the chambers constitutes compressed air that is provided to the respective chambers of the assembly 22 via the manifold assembly 28 and plural lines and valves. In particular, the first or uppermost chamber 22D includes a common passageway 48 (FIGS. 6 and 7) in the lateral side portion of that chamber. The passageway 48 includes plural longitudinally spaced orifices 50 in communication with the interior of the chamber 22D. The passageway 48 is connected to one end of a line or conduit 52. The other end of that line is connected to a valve 54, which in turn is connected to a common fluid passageway or pipe 56 forming a portion of the manifold assembly 28. The common pipe 56 is located within a housing 58. The housing 58 and the common pipe 56 forms the manifold for the inflatable assembly 22 and is disposed on the stretcher along the longitudinal lateral edge 40 of the stretcher immediately adjacent the chambers 22A–22D. The valve 54 is provided to enable fluid, e.g., the compressed air, to either be introduced into the chamber 22D to inflate it or to enable the air within the chamber to exit the chamber to deflate it. The second chamber 22C includes a common passageway 60 having plural longitudinally spaced orifices 62 communicating with the interior of that chamber. A valve 64 is connected to the passageway 60 via a line 66. The valve is in turn connected to the common manifold pipe 56 to enable compressed air to be introduced from the manifold into the common passageway and out through the orifice 62 in the interior of the chamber 22C to inflate that chamber. The valve 64 is also operative to enable the air within the chamber 22C to pass out through the orifice 62, the common passageway 60 and the valve 64 back to the manifold pipe to deflate the chamber. The chamber 22B also includes a common passageway 68 having plural longitudinally spaced orifices (not shown) communicating with the interior of the chamber. A valve 70 is connected to the passageway 68 via a line 72. The valve 72 is in turn connected to the common manifold pipe 56 to enable the chamber 22B to be inflated and deflated in the same manner as chambers 22D and 22C. The fourth or lowermost of the chambers 22A includes a common passageway 74 having plural longitudinally spaced orifices (not shown) in communication with the interior of that chamber. A valve 76 is connected to the passageway 74 via a line 78. The valve is in turn connected to the common manifold pipe 56 so that the chamber can also be inflated and deflated in the same manner as chambers 22D–22B.

The inflatable assembly 24 also includes plural, e.g., four chambers or bags 24A, 24B, 24C and 24D, that are similar in construction to the chambers or bags 22A–22D except that each of the chambers or bags 24A–24D is of the same size and shape. The inflatable chambers 24D, 24C, 24B and 24A are identified in FIG. 10 as "bag 2 layer 1", "bag 2 layer 2", "bag 2 layer 3" and "bag 2 layer 4", respectively. This represents that chamber 24A is the fourth or lowermost chamber, that chamber 24B is the third or next lowermost chamber, that chamber 24C is the second or next uppermost chamber and that chamber 24D is the first or topmost chamber.

Figure 8:
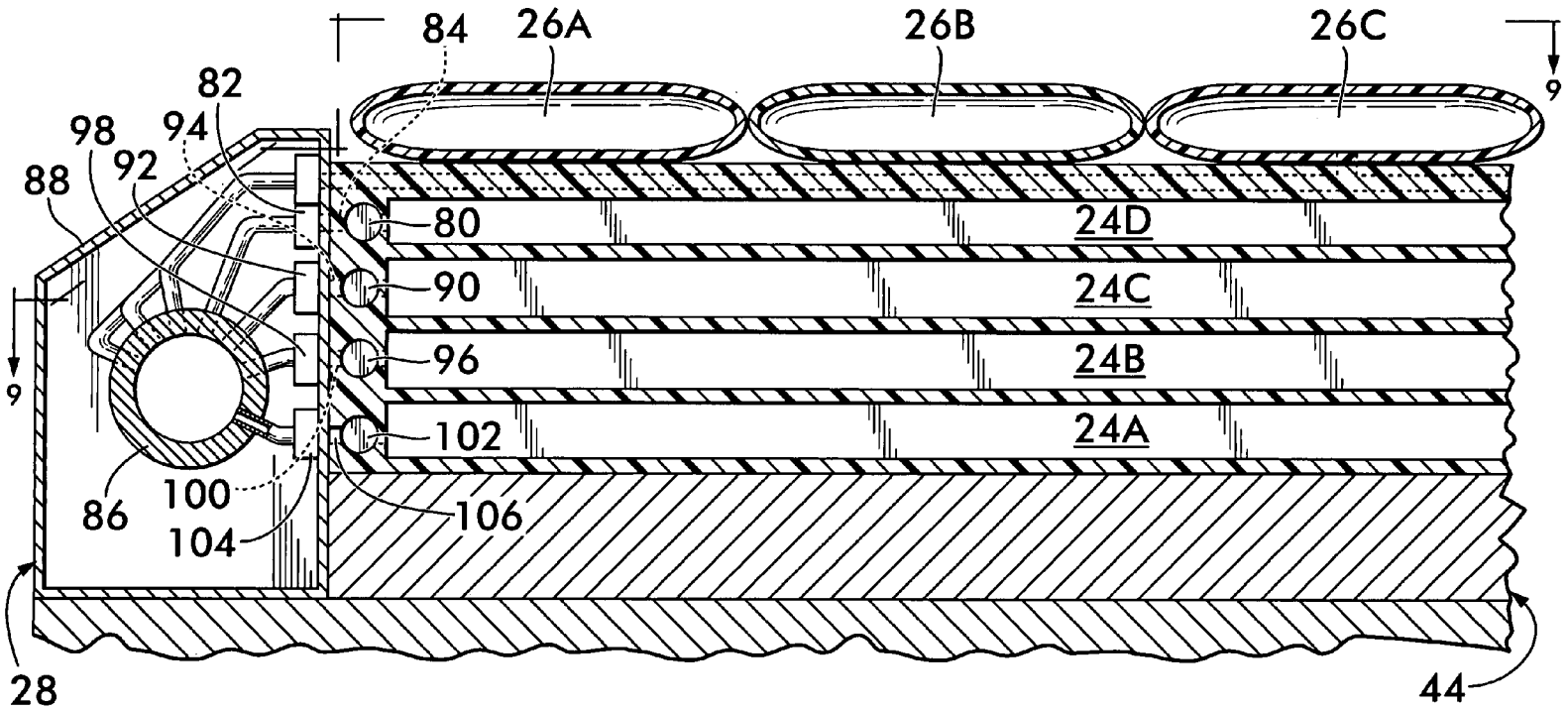
FIG. 8 is an enlarged sectional view taken along line 8—8 of FIG. 2.
Figure 9:
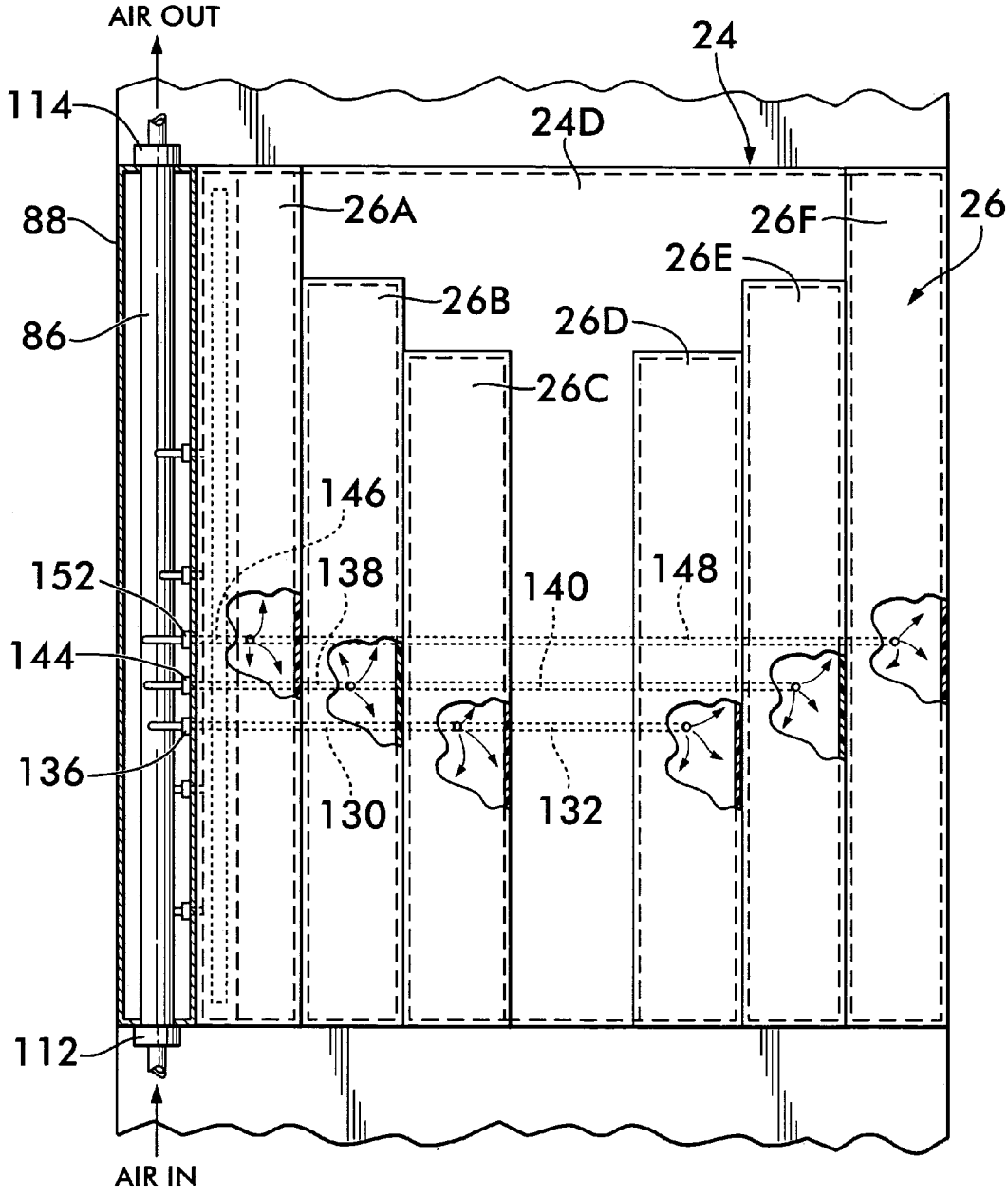
FIG. 9 is a partial sectional view taken along line 9—9 of FIG. 8.

Each chamber 24A–24D is constructed so that it can be inflated from its generally flat condition shown in FIGS. 1 and 8 to a fully inflated wedge shaped condition. The fully wedge shaped condition of the topmost or first chamber 24A is not shown, but is similar to that of the topmost chamber 24A. This maximum inflation of chamber 24A occurs during the transfer of the patient back to the stretcher after the surgery has been completed, as will be described later.

Like the first inflatable assembly 22, the lowermost or fourth chamber 24A of the inflatable assembly 24 is mounted on a top base plate of another base plate subassembly 44. That subassembly is identical in construction to the one discussed earlier except that its bottom base plate is mounted on the top surface of the operating room table. The top base plate is secured to the bottom base plate via plural screws 46.

The inflation and deflation of the chambers 24A–24D is accomplished by means of the manifold assembly 28 and associated lines and valves. In particular, as can be seen in FIGS. 8 and 10, the first or uppermost chamber 24D includes a longitudinally extending passageway 80. This passageway includes a plurality of longitudinally spaced orifices (not shown) communicating with the interior of the chamber 24D. A valve 82 is connected to the passageway 80 via a line 84. The valve is connected to a common manifold pipe 86. This pipe forms another portion of the manifold assembly 28. In particular, the common pipe 86 is located within a housing 88. That pipe and housing form the manifold for the inflatable assembly 24. The valve 82 enables the chamber 24D to be inflated and deflated in a manner similar to that described above. The chamber 24C includes a longitudinally extending passageway 90 having a plurality of longitudinally spaced orifices (not shown) communicating with the interior of the chamber 24C. A valve 92 is connected to the passageway 90 via a line 94. The valve 92 is connected to the common manifold pipe 86. The valve 92 enables the chamber 24C to be inflated and deflated in a similar manner to chamber 24D. The chamber 24B includes a longitudinally extending passageway 96 in it. This passageway includes a plurality of longitudinally spaced orifices (not shown) in communication with the interior of the chamber 24B. The valve 98 is connected to the passageway 96 via line 100. The valve 98 is connected to the common manifold pipe 86 to enable the chamber 24B to be inflated and deflated in a manner similar to chamber 24C. The fourth or lowermost chamber 24A includes a longitudinally extending passageway 102 having a plurality of longitudinally spaced orifices (not shown) in communication with the interior of that chamber. A valve 104 is connected to the passageway 102 via a line 106. The valve 104 is connected to the common manifold pipe 86 to enable the chamber 22A to be inflated and deflated in a manner similar to chamber 22B. The manifold housing 88 for the inflatable assembly 24 is mounted adjacent the inside lateral edge 40 of the operating room table. The wedge shaped chambers 24A–24D are oriented on the operating room table in the same manner as the chambers 22A–22D of the inflatable assembly 22. In particular the chambers 24A–24D flare upward from a short height edge located closely adjacent the inside lateral edge of the table 12 to a long height edge located adjacent the outside lateral edge 42 of the table.

Before describing the cycle of inflation and deflation of the assemblies 22 and 24 of the system 20, it should be noted that the manifold associated with the inflatable assembly 22 also includes an "inlet" valve 108 connected to the inlet end of the common manifold pipe 56. It is at this end where compressed air is supplied via a conduit from a source of compressed air (not shown). Another valve 110 is connected at the opposite or vent end of the common manifold pipe. The valve 110 serves as a "vent" valve to vent air in it to the ambient atmosphere, as will be described later. In a similar manner, the manifold associated with inflatable assembly 24 also includes an "inlet" valve 112 connected at the inlet end of the common manifold pipe 86. It is at this end where the compressed air is supplied via a conduit from the compressed air source. Another "vent" valve 114 is connected to the opposite or vent end of the common manifold pipe 86. This valve 114 serves as the vent valve to vent the air in common manifold pipe 86 to the ambient atmosphere.

As will be appreciated from the discussion to follow, the closing of the vent valve 110 and the opening of the inlet valve 108 of the manifold associated with the inflatable assembly 22 enables compressed air to flow into the common manifold pipe 56. The sequential opening of the valves 76, 70, 64 and 54 of that assembly causes the chambers 22A, 22B, 22C and 22D, respectively, to inflate in sequence. Similarly the closing of the vent valve 114 and the opening of the valve 112 of the manifold associated with the inflatable assembly 24 enables compressed air to flow into the common manifold pipe 86 of that assembly. The sequential opening of the valves 104, 98, 92 and 82 causes the chambers 24A, 24B, 24C and 24D, respectively, to inflate in sequence.

The opening of the vent valve 110 and the closing of the inlet valve 108 of the manifold associated with the inflatable assembly 22 enables its chambers to be deflated in sequence. In particular, the opening of the valves 54, 64, 70 and 76 cause the air in chambers 22D, 22C, 22B and 22A, respectively, to vent out the open vent valve 110. In a similar manner, the opening of the vent valve 114 and the closing of the inlet valve 112 of the manifold associated with the inflatable assembly 22 enables its chambers to be deflated in sequence. In particular, the opening of valves 82, 92, 98 and 104 causes the air in chambers 24D, 24C, 24B and 24A, respectively, to vent through the open vent valve 114.

Figure 3A:
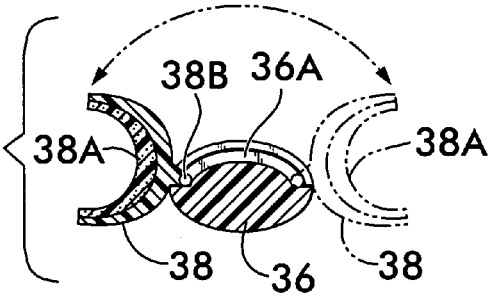
FIG. 3A is an enlarged transverse sectional view of a portion of the system shown in FIG. 3.

Before describing the operation of the inflatable members of the first and second inflatable assemblies 22 and 24, respectively, to effect the transfer of the patient, a brief discussion of the structure and operation of the shoulder support 38 and the fulcrum 36 is in order. To that end, as best seen in FIGS. 1 and 3A, the shoulder support basically comprises an elongated crescent shaped member formed of a somewhat rigid material, e.g., plastic. The crescent shaped member has a relatively soft inner pad or liner 38 extending along its length. The shoulder support 38 includes a pivot pin 38B mounted on its outer surface. The pin 38B is arranged to be located within an arcuate slot 36A in the fulcrum 36. The fulcrum 36 is itself an elongated linear member of generally oval cross-sectional shape and of a relatively rigid material. The fulcrum is located and disposed on top of the two longitudinally extending manifold housings 58 and 88 as clearly shown in FIGS. 1 and 4A. The shoulder support 38 is arranged to be pivoted from the orientation should in FIG. 3A through an arc about the fulcrum 36 in the direction of the arrow in FIG. 3A to move from the leftmost position wherein the supine patient is on the stretcher to the rightmost position (shown in phantom lines) wherein the patient is on the operating table in a horizontal prone orientation. The fulcrum and associated pad cooperate with the inflatable components of the inflatable assemblies 22 and 24 to effect the smooth and safe transfer of the patient from the horizontal supine position on the stretcher to the horizontal prone position on the operating table and then back to the horizontal supine position on the stretcher after the surgery is completed.

In order to ensure that the two inflatable assemblies 22 and 24 do not become separated from one another during their use, the system 20 includes a pair of locking bars 116 and 118. Each locking bar comprises an elongated member having plural projections 120 extending therefrom. The projections are arranged to extend into associated aligned holes in the base 44 of the inflatable assembly 22 located on the stretcher 10 and into associated aligned holes in the base 44 of the inflatable assembly 24 located on the operating room table.

Once the stretcher is in position shown in FIG. 4 and the two inflatable assemblies 22 and 24 are coupled together with the patient's shoulder being located within the shoulder support 38, the system 20 can be operated to effect a transfer and rotation of the patient. This operation will be described with reference to FIGS. 4A–4H.

Referring now to FIG. 4A, it can be seen that the patient is in a horizontally supine position on the top surface of the top inflatable chamber 22D, with his or her shoulder and contiguous upper arm located within the shoulder support. The top surface of the assembly 24 includes a heretofore identified third inflatable assembly 26. The details of that assembly will be described later. At this time the outlet valves 110 and 114 are closed and the inlet valves 108 and 112 are open. Also this time, all of the valves 54, 64, 70 and 76 of the inflatable assembly 22 are closed as are all of the valves 82, 92, 98 and 104 of the inflatable assembly 24. As the first step in the rotation and transfer of the patient 14, the valves 76 and 104 of the assemblies 22 and 24, respectively, are opened, whereupon compressed air is enabled to flow through common manifold pipe 56 and valve 76 into line 78 and from there into the interior of the chamber 22A, thereby causing that chamber to inflate to its wedge shaped condition like shown in FIG. 4B. At the same time the valve 104 of the inflatable assembly 24 is opened, whereupon the compressed air flows from the common manifold pipe 86 through that valve and line 106 into the interior of the chamber 24A, thereby causing that chamber to assume the wedge shaped condition shown in FIG. 4B.

Next the valve 70 of the first inflatable assembly 22 is opened, whereupon the compressed air in the common manifold pipe 56 is enabled to flow through that valve and through line 72 into the interior of the chamber 22B thereby causing that chamber to inflate to its wedge shape condition shown in FIG. 4C. At the same time the valve 98 of the second inflatable assembly 24 is opened, whereupon compressed air in the common manifold pipe 86 is enabled to flow through that valve and line 100 into the interior of the chamber 24B, thereby causing that chamber to assume its wedge shaped condition as shown in FIG. 4C. Valve 64 of the first inflatable assembly 22 is then opened, whereupon compressed air in common manifold pipe 56 is enabled to flow through that valve and line 66 into the interior of chamber 22C to cause that chamber to inflate to its wedge shaped condition as shown in FIG. 4D. At the same time the valve 92 in the inflatable assembly 24 is opened, whereupon compressed air in the common manifold pipe 86 is enabled to flow through that valve and line 94 into the interior of chamber 24C. This action causes that chamber to inflate to its wedge shaped condition shown in FIG. 4D. The inflation of the chambers as described heretofore results in the pivoting of the patient about the fulcrum to a point where the patient is almost in a vertical orientation.

Valve 54 of the inflatable assembly 22 is then opened, thereby enabling compressed air in common manifold pipe 56 to flow through it and line 52 into the chamber 22D. This action causes the chamber 22D to start to inflate to the wedge shaped condition shown in FIG. 4E, whereupon the patient is in a vertical orientation. At the same time the valve 82 of the inflatable assembly 24 is opened to enable compressed air in the manifold pipe 86 to flow through that valve and line 84 into the interior of chamber 24D. This action causes that chamber to partially inflate as shown in FIG. 4E, whereupon the patient receiving surface, that is the top surface of the assembly 24, engages the chest of the patient while the patient is in the vertical upright position.

The valve 54 of the assembly 22 remains open, thereby enabling the chamber 22D to inflate further to the fully expanded wedge shaped condition shown in FIG. 4F. The valves 64, 70 and 76 are closed so that the chambers associated with them remain inflated. At this time the valves 92, 98 and 104 are also closed to ensure that the chambers 24C, 24B and 24A remain inflated.

At the time that the chamber 22D is inflated to bring it to the position shown in FIG. 4F, the inlet valve 112 is closed, the outlet valve 114 is opened and the valve 82 is opened whereupon the air in chamber 24D vents through line 84, valve 82, common manifold pipe 86 and valve 114 to the ambient atmosphere so that the chamber 24D collapses whereupon the patient is rotated to the patient transfer position just slightly in excess of 90 degrees as shown in FIG. 4F. In this orientation the center of gravity of the patient is slightly beyond the vertical plane so that a portion of the patient's weight is now being supported by the engaged top or patient receiving surface of the inflatable assembly 24. In particular, the patient is now facing prone on the patient receiving surface of the inflatable assembly 24. The inlet valve 108 of the assembly 22 is then closed and the outlet valve 110 of that assembly is then opened, whereupon the air within chamber 22D flows through line 52, open valve 54, common manifold conduit 56 and outlet vent valve 110 to the ambient atmosphere, thereby enabling the bag 22 to deflate as shown in FIG. 4G. At the same time the valve 92 of the inflatable assembly 24 is opened, whereupon the air within chamber 24C vents from that chamber through line 94 and valve 92 into the common manifold line 86 and out through the outlet valve 114 to the ambient atmosphere so that the chamber 24C is now collapsed thereby bringing the patient to the position shown in FIG. 4G. The valves 64 and 70 of the inflatable assembly 22 can then be opened, whereupon the air within chamber 22 flows out of that chamber through line 66, open valve 64, common conduit 56 and open vent 110 to the ambient atmosphere, thereby deflating that chamber. The opening of valve 70 causes the air within chamber 22B to flow out of that chamber through line 72, open valve 70, common conduit pipe 56 and open outlet valve 110 to the ambient atmosphere, thereby causing that chamber to collapse to the position shown in FIG. 4H. The valve 76 of the inflatable assembly 22 is then opened, whereupon the air within its associated chamber 22A flows into lines 78, through open valve 76, into common conduit pipe 56 and out through outlet valve 110 to the ambient atmosphere, whereupon that chamber assumes its fully flattened state so that the entire assembly 22 is in the state shown in FIG. 4I. At the same time valve 104 of the inflatable assembly 24 is opened, whereupon air in chamber 24A flows through line 106, open valve 104, common manifold pipe 86 to the open outlet valve 114 and hence to the ambient atmosphere. This action causes the chamber 24A to flatten out, whereupon the entire inflatable assembly 24 is in its compact or flattened condition shown in FIG. 4I. In this condition the patient is now fully horizontal and prone on the operating room table.

The patient's face is supported in the face cradle 30. The shoulder support can now be removed from its engagement with the fulcrum so that the patient's shoulder is not restrained.

As mentioned earlier, it is desirable to include in the system 20 the heretofore identified third inflatable assembly 26. That inflatable assembly comprises a plurality of inflatable chambers, to be described later, that are inflated in sequence so that they cause the patient to be oriented from the flattened horizontally prone position shown in FIG. 5A to the arcuate chest and pelvic orientation shown in FIG. 5B. When the patient is in the orientation shown in FIG. 5B, the face cradle holds the patient's head at a desired angular orientation so as not to interrupt the flow of gases and fluids or otherwise interrupt the patient's respiration.

Referring now to FIGS. 1, 4J, 8 and 9, the details of the third inflatable assembly 26 will now be described. As can be seen, that assembly basically comprises a plurality of longitudinally extending narrow elongated chambers or bladders 26A, 26B, 26C, 26D, 26E and 26F. The outermost pair of bladders, namely, 26A and 26F, are located on the topmost chamber 24D of the assembly 24 and are located along the respective outside edges of that chamber. Moreover, each of the bladders 26A and 26F extends the full length of the chamber 24D. The next innermost pair of bladders, namely, bladders 26B and 26E are disposed inward of bladders 26A and 26F, respectively, on the top of the chamber 24D. The bladders 26B and 26E form an intermediate pair and do not extend the full length of the chamber 24D, but rather terminate slightly before the rear edge of that chamber 24D as best seen in FIG. 1. The innermost pair of the bladders, namely, bladders 26C and 26D are located inward of the intermediate bladders 26B and 26E, respectively. The innermost pair of bladders 26C and 26D are of a shorter length than the intermediate pair of bladders 26B and 26E so that they terminate even further from the edge of the chamber 24D. The arrangement of the gradually shortening length bladders provides an area for comfortable receipt of the patient's pelvic region.

The bladders 26A and 26F, which form the outer pair of bladders are arranged to be inflated in unison. When inflated, the bladders 26A and 26F extend to a maximum height as shown in FIG. 4J. This height is higher or the same height as the height of the maximum inflation of the bladder pair 26B and 26E. That pair of bladders is also inflated in unison. The innermost pair of the bladders 26C and 26D is also arranged to be inflated in unison and when inflated extend to a maximum height which is less than the height of the bladders 26B and 26E. Accordingly, when the bladders of the inflatable assembly 26 are inflated as shown in FIG. 4J, the patient is supported outside inward toward the patient's center line. In fact, since the bladders 26C and 26D are spaced from each other the central portion of the patient is unsupported. That is, the patient is not supported along his/her center line so that there is an area of decompression along the center line of the patient.

In accordance with one preferred aspect of the invention, the amount of inflation of the various bladder pairs of the inflatable assembly 26 is adjustable to accommodate patients of various sizes and shapes.

The inflation and deflation of the bladders 26A–26F is effected via various valve and lines coupled to the common manifold pipe 86 of the inflatable assembly 24. In particular, a pair of branch lines 130 and 132 are connected to the bladders 26C and 26D, respectively, via orifices in communication with the interior of the innermost bladders 26C and 26D, respectively. The branch lines 132 merge with a common line 134 connected to one side of a valve 136. The other side of the valve is connected to the common manifold pipe 86. In a similar manner a pair of branch lines 138 and 140 are connected to the intermediate bladders 26B and 26E, respectively, via orifices in communication with those bladders to a common line 142. The line 142 is connected to one side of a valve 144. The other side of the valve 144 is connected to the common manifold pipe 86. A pair of branch lines 146 and 148 is connected to the bladders 26A and 26F, respectively, via orifices in communication with those bladders. The branch lines 146 and 148 merge into a common line 150 connected to one side of a valve 152. The other side of valve 152 is connected to the common manifold pipe 86.

As mentioned above, the inflation of the bladders of assembly 26 is accomplished in pairs. To that end, when the patient has been brought to the position shown in FIGS. 4I and 5A, the air outlet valve 114 is closed, the air inlet valve 112 is open and the valves 82, 92, 98 and 104 are closed. The valve 152 of the inflatable assembly 26 is then opened, whereupon compressed air flows through the line 150 and the communicating branch lines 146 and 148 into the bladders 26A and 26F to effect their inflation in unison. The valve 144 is then opened, whereupon the compressed air in the common manifold pipe 86 flows through that valve and common line 142 into branch lines 138 and 140. This action causes the bladders 26B and 26E to inflate in unison. The valve 136 is then opened, whereupon compressed air from the common manifold pipe 86 flows through that valve and into the common line 134. The air in the common line then flows through the branch lines 130 and 132 to effect the simultaneous inflation of the bladders 26C and 26D, respectively.

After the surgery is complete, the bladders of the assembly 26 are deflated by opening the outlet valve 114, closing off the compressed air inlet valve 112 and then opening the valves 152, 144 and 136 of the assembly 26. This action causes the air in the pair of bladders 26A and 26F to flow through branch lines 146 and 148, respectively, into common line 150, through valve 152 into the common manifold pipe 86 and out through the open vent valve 114. In a similar manner, air from bladders 26B and 26E flows through the branch lines 138 and 140, respectively, into the common line 142, through open valve 144 into the common manifold pipe 86 and out through the open vent valve 114. Similarly, the bladders 26C and 26D are deflated by opening the valve 136, whereupon the air in those bladders flows through the branch lines 130 and 132 into the common line 134, through open valve 136 and into the common manifold pipe 86 and out through the open vent valve 114.

After the bladders of the inflatable assembly 26 have been deflated, the patient is now ready to be transferred back to the stretcher 10 for removal from the operating room. To that end, the stretcher bearing the inflatable assembly 22 is brought back into position immediately alongside the operating room table like shown in FIG. 2. The inflatable assemblies 22 and 24 are then operated in the reverse manner as described above to effect the pivoting of the patient from the horizontal prone position on the operating table back to the horizontal supine position on the stretcher. The sequence of operation is virtually the same as that described with reference to transferring the patient from the stretcher to the operating table. However, the only difference in the return operation of the patient to the stretcher is that the fourth or uppermost chamber 24D of the assembly 24 is inflated to a fully inflated position whereupon the center of gravity of the patient will be on the opposite side of the vertical plane that is shown in FIG. 4, i.e., a portion of the patient's weight will be disposed on the patient supporting surface of the chamber 22D of the inflatable assembly 22.

It should be pointed out at this juncture that any suitable means can be used to control the various valves and the supply of compressed air, such as a computer or some other controller (not shown). Moreover, the exact sequence of operation need not be precisely as described so long as the patient is rotated in a safe manner about the axis X to transfer him/her from the stretcher to the laterally disposed operating room table and then back to the stretcher after the surgery.

It should also be pointed out that while the patient transport system of this invention is shown to preferably include the inflatable assembly 26, the use of such an assembly is not mandatory. Thus, if for some surgery it is not required to cause the patient's spine to be in a downward arcuate shape like shown in FIG. 5B, the system need not include the third inflatable components. It should also be pointed out the system while being disclosed as being operated pneumatically can be operated hydraulically. Further still, the number and orientation and shape of the various inflatable chambers is a matter of choice and thus the specific number and arrangement shown is merely exemplary. Further still, the various inflatable compartments or components can be fixedly secured to one another, such as shown, or can be releasably secured to one another.

It should also be understood that the inflation and deflation of the inflatable components of the present invention is preferably achieved via pneumatic, i.e., compressed air, control. However, it is within the broadest scope of the present invention to also include hydraulic, i.e., liquid, control or even electronic control (e.g., using electronic actuators), or any combination of pneumatic, hydraulic and electronic control, for controlling the inflation and deflation of the inflatable components.

While the invention has been described in detail and with reference to specific examples thereof, it will be apparent to one skilled in the art that various changes and modifications can be made therein without departing from the spirit and scope thereof.

What is claimed is:

1. A system for transporting and positioning a patient from a movable transportation device onto a laterally located operating room table, the patient being disposed in a supine position on the transportation device, the transportation device being arranged to be located immediately laterally of the operating room table, said system comprising a first inflatable member and a second inflatable member, said first inflatable member having a generally horizontally oriented patient supporting surface, a lateral inside edge and being arranged to be located on the movable transport device with the patient in a supine position on said patient supporting surface of said first inflatable member, said second inflatable member having a generally horizontally oriented patient receiving surface, a lateral inside edge and being arranged to be located on the operating room table and releasably coupled to said first inflatable member when the transportation device is located immediately laterally of the operating room table, said first inflatable member being arranged to be inflated to rotate the supine patient about an axis extending generally parallel to said lateral inside edge of said first inflatable member through an arc slightly in excess of 90 degrees, said second inflatable member being arranged to rotate said patient receiving surface through an arc slightly less than 90 degrees, whereupon the patient is transferred to said patient receiving surface of said second inflatable member in a prone orientation, said second inflatable member being arranged to thereafter be rotated back to its initial horizontal orientation, whereupon the patient is prone on the operating room table.

2. The system of claim 1 wherein said second inflatable member is arranged to be inflated to rotate the horizontally prone patient on the operating room table about an axis extending generally parallel to said lateral inside edge of said second inflatable member through an arc slightly in excess of 90 degrees, said first inflatable member being arranged to rotate said patient supporting surface through an arc slightly less than 90 degrees, whereupon the patient is transferred to said patient supporting surface of said first inflatable member in a supine orientation, said first inflatable member being arranged to thereafter be rotated back to its initial horizontal orientation, whereupon the patient is supine on the movable transportation device.

3. The system of claim 2 additionally comprising a third inflatable member, said third inflatable member having a lateral inside edge and being disposed on said second inflatable member with the inside edge of the second and third inflatable members being adjacent each other, said third inflatable member being arranged when inflated to cause the spine of the prone patient to assume a convex arched shape.

4. The system of claim 3 wherein said third inflatable member comprises plural longitudinally extending inflatable chambers, with the outermost of said longitudinally extending chambers being arranged when inflated to extend to a greater height than the innermost of said longitudinally extending chambers.

5. The system of claim 4 wherein said system includes a manifold to direct fluid into and out of said chambers.

6. The system of claim 5 wherein the amount of fluid introduced into the chambers is adjustable inflation of said chambers is adjustable to accommodate various size patients.

7. The system of claim 2 wherein said first inflatable member comprises a stack of generally wedge shaped inflatable chambers flaring laterally outward from said lateral inside edge, each of said chambers being arranged to be inflated and deflated.

8. The system of claim 7 wherein said wherein said system includes a manifold to direct fluid into and out of said chambers.

9. The system of claim 2 additionally comprising a shoulder support located immediately adjacent said lateral inside edge of said first inflatable member and said lateral inside edge of said second inflatable member, said shoulder support being arranged to receive and support the shoulder of the patient when said first inflatable member rotates the supine patient about an axis extending generally parallel to said lateral inside edge of said first inflatable member through an arc slightly in excess of 90 degrees.

10. The system of claim 2 additionally comprising a cradle located on the operating room table adjacent said second inflatable member to receive the face of the prone patient.

11. The system of claim 2 additionally comprising a leg support pad located on the transporting device for disposition under the knees of the supine patient.

12. The system of claim 2 additionally comprising a leg support pad located on the operating room table to serve as a footrest for the prone patient.

13. The system of claim 2 wherein said first and second inflatable members are releasably coupled together by a locking bar.

14. The system of claim 1 additionally comprising a third inflatable member, said third inflatable member having a lateral inside edge and being disposed on said second inflatable member with the inside edge of the second and third inflatable members being adjacent each other, said third inflatable member being arranged when inflated to cause the spine of the prone patient to assume a convex arched shape.

15. The system of claim 14 wherein said third inflatable member comprises plural longitudinally extending inflatable chambers, with the outermost of said longitudinally extending chambers being arranged when inflated to extend to a greater height than the innermost of said longitudinally extending chambers.

16. The system of claim 15 wherein said system includes a manifold to direct fluid into and out of said chambers.

17. The system of claim 16 wherein the amount of fluid introduced into the chambers is adjustable inflation of said chambers is adjustable to accommodate various size patients.

18. The system of claim 1 wherein said first inflatable member comprises a stack of generally wedge shaped inflatable chambers flaring laterally outward from said lateral inside edge, each of said chambers being arranged to be inflated and deflated.

19. The system of claim 18 wherein said wherein said system includes a manifold to direct fluid into and out of said chambers.

20. The system of claim 1 additionally comprising a shoulder support located immediately adjacent said lateral inside edge of said first inflatable member and said lateral inside edge of said second inflatable member, said shoulder support being arranged to receive and support the shoulder of the patient when said first inflatable member rotates the supine patient about an axis extending generally parallel to said lateral inside edge of said first inflatable member through an arc slightly in excess of 90 degrees.

21. The system of claim 1 additionally comprising a cradle located on the operating room table adjacent said second inflatable member to receive the face of the prone patient.

22. The system of claim 1 additionally comprising a leg support pad located on the transporting device for disposition under the knees of the supine patient.

23. The system of claim 1 additionally comprising a leg support pad located on the operating room table to serve as a footrest for the prone patient.

24. The system of claim 1 wherein said first and second inflatable members are releasably coupled together by a locking bar.

25. The system of claim 1 wherein said first and second inflatable members are pneumatically controlled.

26. The system of claim 1 wherein said first and second inflatable members are hydraulically controlled.

27. The system of claim 1 wherein said first and second inflatable members are electronically controlled.

28. The system of claim 1 wherein said first and second inflatable members are pneumatically and hydraulically controlled.

29. The system of claim 1 wherein said first and second inflatable members are hydraulically and electronically controlled.

30. The system of claim 1 wherein said first and second inflatable members are pneumatically and electronically controlled.

31. The system of claim 1 wherein said first and second inflatable members are pneumatically, hydraulically and electronically controlled.

32. A system for transporting and positioning a patient from a movable transportation device onto a closely adjacent surgical table, the patient being disposed in a supine position on the transportation device, said system comprising a first patient support member, a second patient support member and a patient torso support member, said first patient support member having a patient receiving surface and being arranged to be located on the movable transport device with the patient in a supine position on said patient receiving surface, said second member having a patient receiving surface, said second member being arranged to be located on the surgical table, said first and second members being arranged to cooperate to rotate the patient to a position transferring the patient to the patient receiving surface of said second member, with the torso of the patient on said torso support member and with said patient being prone with respect to the surgical table, said torso support member being arranged to cause the spine of the prone patient to assume a convex arched shape.

33. The system of claim 32 wherein said torso support member is arranged to be actuated to assume an arcuate state for causing the spine of the prone patient to assume the convex arched shape.

34. The system of claim 33 wherein said torso support member is inflatable to assume said arcuate state.

35. The system of claim 34 wherein said inflatable torso support member has a longitudinal axis and comprises plural longitudinally extending inflatable chambers disposed on opposite sides of said longitudinally extending axis, with the outermost of said longitudinally extending chambers being arranged when inflated to extend to a greater height than the innermost of said longitudinally extending chambers.

36. The system of claim 32 wherein said first patient support member is inflatable and wherein said second patient support member is inflatable.

* * * * *